US005131127A

United States Patent [19]

Nickerson et al.

[11] Patent Number: 5,131,127

[45] Date of Patent: Jul. 21, 1992

[54] TOOL FOR REMOVING A SPLIT WASHER

[75] Inventors: Larry Nickerson, Charlotte, N.C.; Richard E. Potesta, Chesterland, Ohio

[73] Assignee: Milbar Corporation, Chagrin Falls, Ohio

[21] Appl. No.: 619,244

[22] Filed: Nov. 28, 1990

[51] Int. Cl.[5] ..... B25B 27/20

[52] U.S. Cl. ..... 29/229; 29/268; 29/243.56; 81/485

[58] Field of Search ..... 29/229, 243.56, 268, 29/283.5, 253; 81/485

[56] References Cited

U.S. PATENT DOCUMENTS 2,832,128 4/1958 Erdmann ..... 29/229

3,401,444 9/1968 Kovacs ..... 29/229

*Primary Examiner*—Roscoe V. Parker

*Attorney, Agent, or Firm*—Calfee Halter & Griswold

[57] ABSTRACT

A tool for removing a split washer, such as a brake lever "C" clamp, from a groove in a projection, such as would be found on a brake lever pivot is provided. The tool includes a first lever member; a second lever member pivotally interconnected to the first lever member at a pivotal axis; a gripping component manipulatable by the first lever member; and a cooperating component manipulatable by the second lever member. The distal end of the gripping component and the distal end of the cooperating component are located an equal distance from the pivotal axis to facilitate the gripping component to grip a portion of the washer. The cooperating component may be viewed as a wedge component as it is shaped to progressively increase the distance between the washer legs in correlation to the position of the first lever member relative to the second lever member until the inner geometery of the washer is sufficient to remove the washer from the projection. In an alternate embodiment, the distal end of the gripping component is closer to the pivot axis than the distal end of the cooperating component to facilitate the gripping of an upper portion of the projection. In this embodiment, the cooperating component may be a wedge component, however it acts more as a prying component to force the split washer off of the groove.

27 Claims, 2 Drawing Sheets

TOOL FOR REMOVING A SPLIT WASHER

FIELD OF THE INVENTION

This invention relates generally to a tool for removing a split washer from groove in a projection and more particularly to a tool for removing a brake lever "C" clamp from an emergency or hand brake lever pivoting pin.

BACKGROUND OF THE INVENTION

Many cars and trucks, both foreign and domestic, use "C" clamps in the assembly of emergency or hand brake systems. As the name implies, a "C" clamp is shaped roughly like a "C" and has a pair of legs extending from a rounded connecting portion. A "C" clamp is a popular form of a split washer which is a fastening device having two legs extending from a connecting portion. The washer legs will be separated by a gap of a certain width, and the washer may be opened and closed by adjusting the width of the gap. The "open" width of the gap is greater than the "closed" width of the gap. The closed width can be, but is not necessarily, equal zero. The inner surfaces of the connecting portion and legs of the washer may be viewed as defining an inner circumference of the washer. The width of the gap and the inner circumference of the washer may be collectively termed the "inner geometry" of the washer.

A brake system will usually include a brake lever which must be pivotally connected to a brake shoe. The brake lever typically includes a projection, or a pivot pin, having a groove and a distal portion beyond this groove. The pivot pin extends through an opening in the brake shoe, this opening usually being only slightly larger than circumference the pivot pin. A closed split washer, or "C" clamp is installed within the groove. In other words, the inner circumference of the washer is less than the circumference of the projection and the washer is trapped in the groove which is between the brake shoe and the distal portion of the pivot pin. The washer is of a sufficient thickness so that, even in a closed condition, its outer circumference extends well beyond the circumference of the projection. In this manner, the pivot pin cannot pass through the opening in the brake shoe.

In cars and trucks, brake shoes wear out on a regular basis and the replacement of brake shoes is a routine maintenance item. To remove a brake shoe, it must be disconnected from the brake lever. Thus the split washer must be removed so that the pivot pin may pass through the hole in the brake shoe. To remove the washer, its legs must be pried far enough apart so that it can be slipped off the distal portion of the pivot pin. In other words, the width of the gap between the washer legs must be increased until the inner geometry of the washer is sufficient to remove the washer from the pin.

In the past, conventional tools such as screw drivers, pliers, drill chisels and other instruments were crudely employed to open the split washer. Use of these conventional tools to manipulate split washers, while sometimes eventually successful, were a common cause of frustration and skinned knuckles to the mechanics performing the task. Additionally, removing split washers with these conventional tools was time consuming due to their incompatibility with the shape of the split washer. In fact, most mechanics would agree that in the brake shoe replacement process, removing the split washer with conventional tools took longer than actually removing the old brake shoe and installing a new one.

A need therefore remains for a tool which can quickly and easily remove a split washer from a brake lever pivot pin.

SUMMARY OF THE INVENTION

The present invention provides a tool for removing a split washer, such as a brake lever "C" clamp, from a projection, such as a brake pivot pin. The tool includes a first lever member; a second lever member pivotally interconnected to the first lever member at a pivotal axis; a gripping component manipulatable by the first lever member; and a cooperating component manipulatable by the second lever member. The gripping component is shaped to grip a portion of the gripping surface formed by the back surfaces of the projection and the split washer. The cooperating component is shaped to progressively increase the distance between the washer legs in correlation to the position of the first lever member relative to the second lever member until the inner geometry of the washer is sufficient to remove the washer from the projection.

The first lever member and the second lever member each have a handle portion and a jaw portion. The gripping component is located at one end of the jaw portion of the first lever member and the cooperating component is located at one end of the jaw portion of the second lever member. The distal end of the gripping component and the distal end of the cooperating component are located an equal distance from the pivotal axis to facilitate the gripping of a portion of the washer. The cooperating component is shaped to linearly increase the distance between the washer legs and includes an element having two sloped walls which join at an apex, this apex aiming inwardly towards the gripping component. The gripping component includes a notch extending substantially parallel to the pivotal axis.

In an alternate embodiment, the distal end of the gripping component is closer to the pivot axis than the distal end of the cooperating component to facilitate the gripping of an upper portion of the projection. In this embodiment, the cooperating component may be a wedge component, however, it functions more as a prying component to force the split washer off of the groove while the gripping component acts as a mandril. The cooperating component may be wedge-shaped or any other shape suitable for the necessary prying action.

To remove a split washer from a groove in a projection according to the present invention, either the connecting portion of the washer or the upper portion of the projection is gripped. The width of the gap between the washer legs is then progressively increased until the inner geometry of the washer is sufficient to remove the washer from the projection. A sufficient increase would be when the inner circumference of the washer is greater that the circumference of the upper portion of the projection and/or the width of the gap is greater than the diameter of the groove.

Thus, the present invention provides a tool for removing a split washer from a projection. With such a tool, a brake lever "C" clamp may be quickly and painlessly removed from a brake lever pivoting pin.

To the accomplishment of the foregoing and related ends, the invention comprises the features hereinafter fully described and particularly pointed out in the claims, the following description setting forth in detail certain illustrative embodiments of the invention, these being indicative, however, of the various ways in which the principles of the invention may be employed.

DETAILED DESCRIPTION

Figure 2:
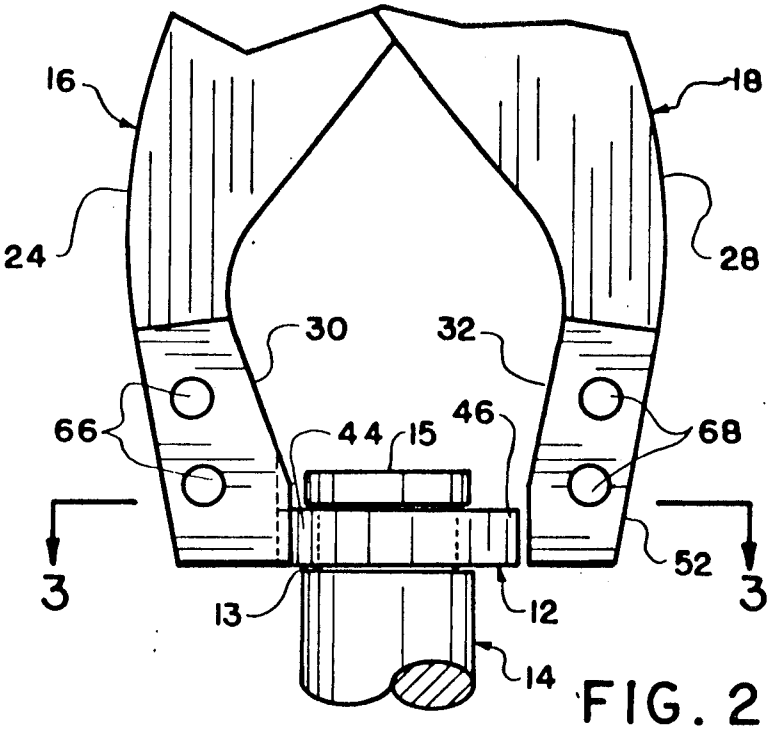
Figure 1:
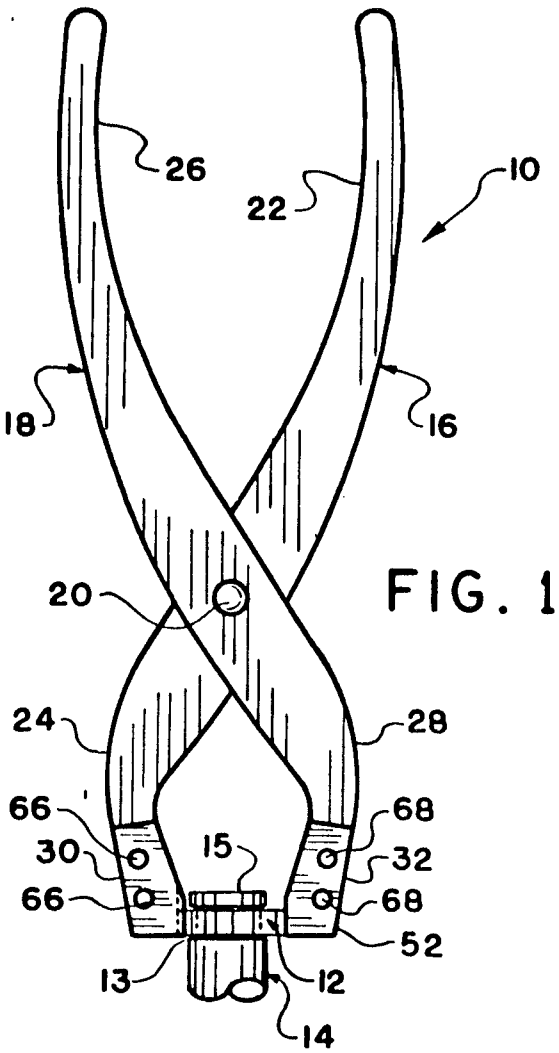
FIG. 1 is a side view of a tool according to the present invention the tool being shown positioned to remove a split washer from FIG. 2 is enlarged view of the lower portion of the tool, the washer, and the projection of FIG. 1.

Referring now to the drawings in detail and initially to FIGS. 1 and 2, a tool according to the present invention is indicated generally at 10. The tool 10 is shown positioned to remove a split washer 12 from a groove 13 in a projection 14. The projection 14 includes a distal portion 15 extending beyond the groove 13. The split washer 12 illustrated is typical of a brake lever "C" clamp and the projection 14 is typical of the part of a brake lever pivoting pin which would be inserted through the opening in a brake shoe.

The tool 10 includes a first lever member 16, and a second lever member 18 pivotally interconnected to the first lever member at a pivotal axis by pivot pin 20. The first lever member 16 has a handle portion 22 and a jaw portion 24; the second lever member 18 has a handle portion 26 and a jaw portion 28. The tool 10 also includes a gripping component 30 attached to the jaw portion 24 of the first lever member 16 and a cooperating component 32 attached to the jaw portion 28 of the second lever member 18. The gripping component 30 may be manipulated by the first lever member 16 and the cooperating component 32 may be manipulated by the second lever member 18. More specifically, when inward pressure is exerted on either or both of the handle portions 22 and 26, the gripping component 30 and/or the cooperating component 32 will move inwardly. In this manner, these components may coact to open a split washer 12 so it may be removed from a groove in a projection.

Figure 3:
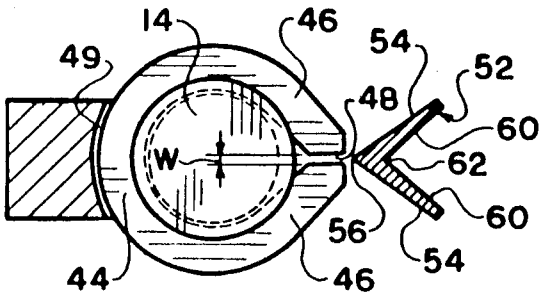
FIG. 3 is a top sectional view as seen along line 3—3 in FIG. 2.

Referring now additionally to FIG. 3, it may be seen that the washer 12 includes a rounded central portion 44 and two legs 46 extending therefrom. The washer 12 typically is stamped from a piece of sheet metal and hence, the connecting portion 44 and the legs 46 are of approximately the same thickness. The legs 46 are separated by a gap 48 of a certain width "w". The inside surfaces of the connecting portion 44 and the legs 46 may be viewed as defining an inner circumference (outer dashed line). Similarly, the outside surfaces of the connecting portion 44 and the legs 46 may be viewed as defining an outer circumference (outer solid line).

When the washer 12 is in a closed condition as shown in FIG. 3, the inner circumference of the washer (outer dashed line) is less than the circumference of the projection 14 (inner solid line). Additionally, the width of the gap 48 is less than the diameter of the groove 13. The washer 12 is thereby trapped in the groove 13. In a typical brake shoe application, the washer 12 would be trapped between a brake shoe and a distal portion of a pivot pin. The thickness of the washer 12 should great enough so that, even in closed condition, its outer circumference is greater than the opening in the brake shoe so the pin can not pass therethrough.

The tool 10 is shown in FIGS. 1—3 in a pre-removal position, or the position the tool would be placed in before inward pressure would be exerted on the handle portions 22 and 26 to remove the washer 12. When the tool 10 is in this position, the gripping component 30 is positioned for gripping the connecting portion 44 of the washer 12. The gripping component 30 includes a notch 49 extending substantially parallel to the pivotal axis of pin 20. The notch 49 is preferably shaped to conform to the outer circumferential geometry of the washer 12. In the illustrated embodiment, the connecting portion 44 is roughly in planar section and thus the notch 49 follows a curved path (See FIG. 3). With a typical "C" clamp split washer, the notch 49 would be approximately 3/16" high, ⅜" wide and ⅛" deep. Of course if other sizes and/or types of split washers are used, the gripping component 30 would be appropriately modified to conform to the size and/or geometry of the washer.

On the opposite side of the washer 12, the cooperating component 32 is positioned to wedge apart the legs 46 of the washer 12 and thus may be viewed as a wedge component. The cooperating component 32 is shaped to progressively increase the width of the gap 48 between the washer legs 46 until the inner circumference of the washer !2 is greater than the circumference of the projection 14. Due to the interconnection of the parts of the tool, the increasing of the gap correlates to the position of the first lever member 16. relative to the second lever member 18.

The cooperating component 32 includes a "V" shape element 52 which has two sloped outer walls 54 which join at an apex 56. As is best seen FIG. 3, the apex 56 aims inwardly, or towards the gripping component 30 and is positioned at or near the gap 48 between the washer legs 46. The "V" shape element 52 also has two sloped inner walls 60 which join at a corner 62.

When inward pressure is applied to the handle portions 22 and 26, as when a user manually presses the handle portions together, the wedge apex 56 will be forced between the legs 46 of the washer 12. As the element 52 travels inwardly, the wedge outer walls 54 will push the legs 46 away from each other, or increase the width of the gap 48, until the inner circumference of the washer is greater than the circumference of the projection 14 and, more specifically, greater than the circumference of the upper distal portion 15. The washer 12 may then be slipped off of the projection 14.

To perform this "wedging" function properly, the angle formed by the wedge outer walls 54 and the width of the "V" shape element 52 should be sufficient to increase the width of the gap the necessary amount. The element 52 should also preferably extend at least slightly above the split washer 12 when in a pre-removal position to insure an equal distribution of force on the washer. With a typical brake lever "C" clamp, an angle of 70°, a width of 9/16" and a height of 3/16" would be appropriate.

At this point the relation between the pivotal axis of pin 20 and the gripping/cooperating components 30 and 32 should be noted. In the illustrated embodiment, the gripping notch 49 runs parallel to the pivotal axis, and the "V" shape element 52 is situated in a complimentary fashion. When the tool 10 is in a pre-removal position, the pivotal axis of pin 20 is approximately perpendicular to the projection 14. (See FIG. 1.) Thus, to position the tool 10 in this pre-removal portion, it would approach the horizontal split washer !2 in a vertical direction in FIG. 1.

However, the tool could be modified to accommodate applications requiring different angles of approach. For example, the gripping and cooperating components could be rotated 90 degrees relative to the pivotal axis of pin 20. If a tool was so modified, the pivotal axis would be approximately parallel to the projection-when the tool was in a pre-removal position. The tool could then approach a horizontally placed split washer "sideways". Many other modifications are also possible, the important factor being that the gripping component 30 and the cooperating component 32 are arranged to grip, and wedge, respectively, the split washer 12, when the desired angle of approach is used.

Turning now to the details of the lever members 16 and 18, in the illustrated embodiment they are part of a conventional pair of pliers. In operation, inward pressure would be applied to the handle portions 22 and 26, such as by manually squeezing the handle portions together. Manual operation would probably be most convenient in a garage setting where a brake shoe replacement job is usually done. However, other methods of applying the necessary pressure are of course possible and may be desirable in other applications.

If a conventional pair of pliers is used, the gripping component 30 and cooperating component 32 would preferably be removably secured to the pliers. In this manner, the replacement of the gripping component and the cooperating component could be accomplished by simply removing the old components and substituting new. Additionally, a tool may be easily altered to accommodate various sizes and shapes of split washers.

Regarding the attachment of the components, the gripping component 30 are removably secured to the jaw portion 24 of the first lever member 16 by screws 66. The cooperating component 32 would likewise be removably secured to the jaw portion 28 of the second lever member 18, however, a quick release mechanism 68 is employed. By using a quick-release mechanism, the cooperating component 32 can be selectively rotated 180 degrees as is shown in FIG. 4.

Figure 4:
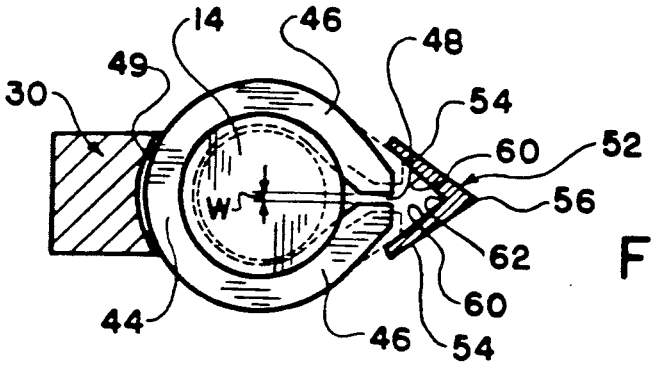
FIG. 4 is a view similar to that of FIG. 3 except that the split washer is open and the cooperating component of the tool has been adjusted to crimp the legs of the washer.

If the cooperating component 32 is adjusted as shown in FIG. 4, the cooperating component may then function as a "crimping component" and the tool 10 may then be used to install a split washer on a projection. Such a function may be helpful in re-connecting the brake lever after a brake shoe has been replaced. After the brake shoe is replaced, the pivot pin is inserted through an opening in the new brake shoe and a new open split washer is placed in the groove on the pivot pin. While the original split washer may be reused, these items are generally inexpensive and thus more often than not a new washer will be used. However, whatever washer is used, it must be closed. This closing is accomplished by crimping the legs, or decreasing the width of the gap between the legs, at least until the inner circumference of the washer is less than the circumference of the projection.

The pre-installation condition shown in FIG. 4 is the position the tool 10 would be placed in before inward pressure would be exerted on the handle portions 22 and 26 to crimp the legs 46 of the washer. The washer 12 is sufficiently closed when the inner circumference of the washer is less than the circumference of the projection 14. As the "V" shape element 52 travels inward, the legs 46 are forced towards the corner 62 and thus crimped together closing the washer.

The angle formed by the inner walls 60 at the corner 62 should be of a sufficient magnitude to crimp the legs 46 together. With a typical brake lever "C" clamp, an angle of 80 degrees would be appropriate. Note this angle is different than the suggested angle of the outer apex 56--70 degrees —discussed above. Thus the thickness of the "V" shape element 52, or the distance between an outer wall 54 and an inner wall 60, increases towards the apex 56 and/or corner 62. Aside from being dimensioned to correctly form the wedging/crimping functions, the thickness of the element 52 need only be great enough to withstand operating pressures without deformation.

Figure 5:
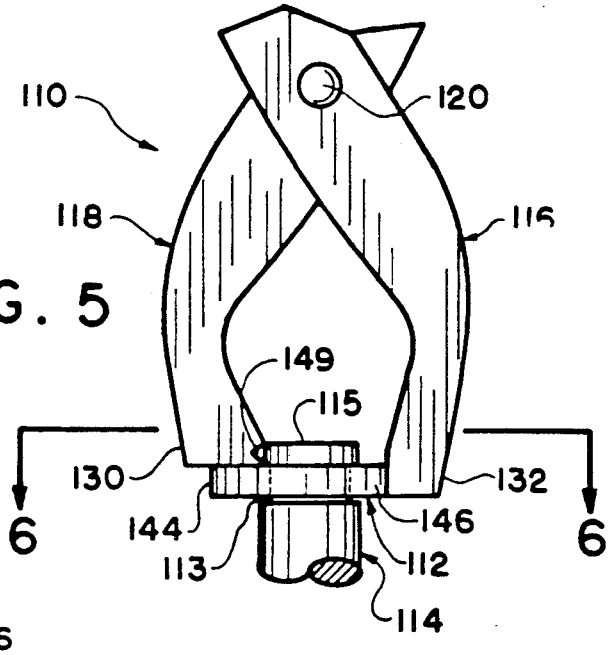
FIG. 5 is a side view of the lower portion of another tool for removing washer according to the present invention, the tool shown positioned to remove a split washer from a projection.
Figure 6:
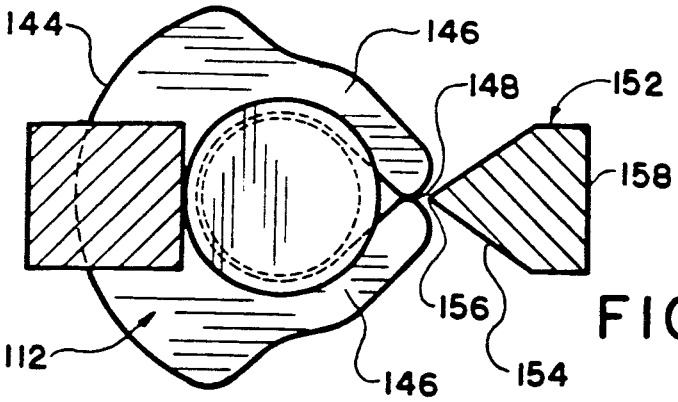
FIG. 6 is a top sectional view as seen along line 6—6 in FIG. 5.

Referring now to FIGS. 5 and 6, another tool 110 according to the present invention is shown positioned to remove a split washer 112 from a groove 113 in a projection 114. The projection 114 may be identical to the projection 14 discussed above and includes an upper distal portion 115 extending beyond the groove 113. The washer 112 is shown in a closed condition, the inner circumference of the washer (outer dashed line) being less than the circumference of the projection 1!4 (inner solid line). Additionally, the width of the gap between the washer legs is less than the diameter of the groove. (See FIG. 3.)

The washer 112 is similar to the washer 12 illustrated in FIGS. 1–4 and has a rounded connecting portion 144 and two legs 146 extending therefrom. However, while the connecting portion 44 and the legs 46 of washer 12 are of approximately the same width, the washer 112 is shaped somewhat differently. Specifically, the connecting portion 144 is of a much larger width, or transverse area, than the legs 146. Although tool 110 may be used to remove many types of split washers, including ones similar to washer 12, it has been found to be especially useful with washers shaped like washer 112.

The tool 110 includes a first lever member 116, a second lever member 118 pivotally interconnected to the first lever member at a pivotal axis 120, a gripping component 130 and a cooperating component 132. As with the tool !0, the gripping component 130 is manipulatable by the first lever member 116 and the cooperating component 132 is manipulatable by the second lever member 118. However, in tool 110 the gripping component 130 and the cooperating component 132 are formed integrally with the lever members.

One of the differences between tools 10 and 110 is best explained by referring briefly back to FIG. 1. In tool 10, the distal ends of the gripping component 30 and the cooperating component 32 are located an equal distance from the pivotal axis of the pin 20. This construction allows the gripping component 30 to grip the central portion 44 of the washer 12. In contrast, with tool 110 shown in FIGS. 5 and 6, the distal end of the gripping component 130 is closer to the pivotal axis 120 than the distal end of the cooperating component 132.

Thus, when the tool 110 is in a pre-removal position as shown, the distal end of the gripping component 130 is above the distal end of the cooperating component 132, a distance at least as great as the height of the washer 112. In this manner, the gripping component 130 may grip the projection 114 instead of a portion of the washer. It has been found that less force is necessary with this arrangement to separate the washer legs the required amount than when the gripping component grips a portion of the washer. Additionally, the cooperating component may act as a prying component rather than a traditional wedge component.

Figure 7:
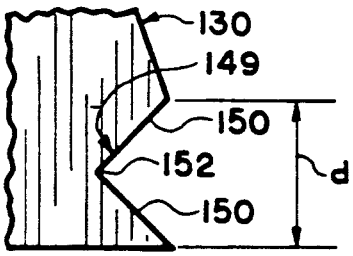
FIG. 7 an enlarged view of the gripping component of the tool of FIG. 5.

The gripping component 130 includes a notch 149 extending substantially parallel to the pivotal axis 120 of the lever members 116 and 118. The notch 149 is "V" shape having two sloped walls 150 which meet at an inward corner 152. The outer edges of the walls 150 are straight, not curved like the embodiment above, and are spaced a distance "d" apart. (See FIG. 7.) The distance "d" is such that the edge of the top wall 150 may grip the top of the distal portion 115 of the projection 114 and the edge of the lower wall 150 will rest just below the distal portion 115 in the groove 113.

While most brake lever pivot pins have distal portions of approximately the same height, slight variations are known to occur. The "V" shape of the notch 149 allows the gripping component 130 to be more forgiving of slight variances in pivot pins. In the illustrated embodiment, the angle formed by the outer walls is approximately equal to 45°, however other angles would be possible as long as the dimension "d" is adequate for the gripping function. Other shaped notches, such as "U" shape notches are of course possible.

The cooperating component 132 may act as a wedge component and includes a triangle element 152 which has two sloped outer walls 154 which join at an apex 156. The opposite ends of the walls 154 are connected by a third back wall 158. As best seen in FIG. 6, the apex 156 aims inwardly or towards the gripping component 130 and is positioned at or near the gap 148 between the washer legs 146. The angle formed by the walls 154 at apex 156 is preferably between 15° and 175° and more preferably approximately equal to 45°. In any event, the magnitude of the angle and the length of the sloped walls 154 should be sufficient to separate the legs 146 the necessary amount.

The tool 110 may operate essentially the same as tool 10 in other ways. For example, in the illustrated pre-removal position, the apex 156 of the cooperating component 132 aims towards the intersection of the legs 146 of the washer 112. When inward pressure is applied on the handle portions (not shown) of levers 116 and 118, the legs 146 of the washer 112 will be forced apart. However, the cooperating component 132 may act more as a prying component to force the split washer 112 off of the projection 114. In such a "prying" arrangement, the cooperating component 132 should be shaped to separate the washer legs 146 so that the width of the gap is greater than the diameter of the groove 113.

Thus, to remove a split washer from a groove in a projection according to the present invention, either the connecting portion of the wash or the upper portion of the projection is gripped. The width of the gap between the washer legs is then progressively increased until the inner geometry of the washer is sufficient to remove the washer from the projection. A sufficient increase would be when the inner circumference of the washer is greater than the circumference of the upper portion of the projection and/or the width of the gap is greater than the diameter of the groove. The gripping step and the increasing step may be performed by the manipulation of a first lever member having a gripping component attached thereto and a second lever member having a cooperating wedge component attached thereto.

One may now appreciate that the present invention provides a tool for easily removing and installing a split washer, such as a brake lever "C" clamp, on a projection, such as brake lever pivoting pin. With the present invention, a brake lever "C" clamp may be removed or installed on a brake lever pivoting pin with a minimum amount of effort.

Although the invention has been shown and described with respect to certain preferred embodiments, equivalent alterations and modifications will be obvious to others skilled in the art upon the reading and understanding of this specification. For example, the wedge or prying component could be curved, rather than straight whereby the gap between the washer legs would be increased exponentially. The present invention includes all such equivalent alterations and modifications, and is limited only by the scope of the following claims.

What is claimed is:

1. A tool for removing a split washer from a groove in a projection; such projection having an upper portion extending above such groove; such washer having a pair of legs extending form a connecting portion; the legs being separated by a gap of a certain width smaller than the diameter of such groove such that an inner circumference of such washer is less than the circumference of the upper portion of such projection; said tool comprising:

a first lever member;

a second lever member pivotally interconnected to said first lever member at a pivotal axis;

gripping means, manipulatable by said first lever member, for gripping either the connecting portion of such washer or the upper portion of such projection;

crimping means, manipulatable by said second lever member, for crimping together such legs of such washer; and wedge means, manipulatable by said second lever member, for wedging apart the legs of such washer;

said wedge means being shaped to progressively increase the width of the gap between the washer legs, in correlation to the position of said first lever member relative to said second member, until the inner geometry of such washer is sufficient to remove the washer from the projection.

2. A tool as set forth in claim 1 wherein said wedge means is shaped to linearly increase the distance between such washer legs.

3. A tool as set forth in claim 2 wherein said wedge means includes an element having two sloped outer walls which join at an apex and wherein said apex aims inwardly towards said gripping means.

4. A tool as set forth in claim 3 wherein said first lever and said second lever each have a handle portion and a jaw portion; wherein said gripping means is located at the free end of said jaw portion of said first lever member; and wherein said wedge means is located at the free end of said jaw portion of said second lever member.

5. A tool as set forth in claim 4 wherein said element is "V" shape and has two sloped inner walls which join at a corner and wherein said inner walls slope inwardly towards said apex.

6. A tool as set forth in claim 5 wherein said gripping means and said wedge means are removably attached to said first lever member and said second lever member, respectively.

7. A tool as set forth in claim 6 further comprising quick release means for rotating said wedge means 180° relative to said jaw portion of said second lever member.

8. A tool as set forth in claim 7 wherein the distal end of said gripping means and the distal end of said wedge means are located an equal distance from said pivotal axis whereby said gripping means may grip such connection portion.

9. A tool as set forth in claim 1 wherein the distal end of said gripping means and the distal end of said wedge means are located an equal distance from said pivotal axis whereby said gripping means may grip such connection portion.

10. A tool for removing a split washer from a groove in a projection; such projection having an upper portion extending above such groove; such washer having a pair of legs extending from a connecting portion; the legs being separated by a gap of a certain width smaller than the diameter of such groove such that an inner circumference of such washer is less than the circumference of the upper portion of such projection; said tool comprising:

a first lever member;

a second lever member pivotally interconnected to said first lever member at a pivotal axis;

gripping means, manipulatable by said first lever member, for gripping the upper portion of such projection;

wedge means, manipulatable by said second lever member, for wedging apart the legs of such washer;

said wedge means being shaped to progressively increase the width of the gap between the washer legs, in correlation to the position of said first lever member relative to said second member, until the inner geometry of such washer is sufficient to remove the washer from the projection;

wherein the distal end of said gripping means is closer to said pivotal axis than the distal end of said wedging means, whereby said gripping means may grip such upper portion.

11. A tool as set forth in claim 10 wherein said gripping means includes a notch extending substantially parallel to said pivotal axis.

12. A tool as set forth in claim 10 wherein said gripping means and said wedge means are integrally formed with said first lever member and said second lever member.

13. A tool as set forth in claim 11 wherein said gripping means and said wedge means are integrally formed with said first lever member and said second lever member.

14. A tool as set forth in claim 13 wherein said wedge means is triangular shape having a third back wall connecting said two sloped outer walls.

15. A tool as set forth in claim 14 wherein said outer sloped walls form an angle at said apex and said angle is between 15° and 70°.

16. A tool as set forth in claim 15 wherein said angle is approximately equal to 45°.

17. A tool as set forth in claim 16 wherein the width of said notch is at least as great as the height of such upper portion of such projection.

18. A tool as set forth in claim 10 wherein said wedge means is shaped to linearly increase the distance between such washer legs.

19. A tool as set forth in claim 18 wherein said wedge means includes an element having two sloped outer walls which join at an apex and wherein said apex aims inwardly towards said gripping means.

20. A tool as set forth in claim 19 wherein said first lever and said second lever each have a handle portion and a jaw portion; wherein said gripping means is located at the free end of said jaw portion of said first lever member; and wherein said wedge means is located at the free end of said jaw portion of said second lever member.

21. A method for removing a split washer from a groove in a projection; such projection having an upper portion extending above said groove; such washer having a pair of legs extending from a connecting portion; the legs being separated by a gap of a certain width such that the inner circumference of the washer is less than the circumference of the upper portion of such projection; said method comprising the steps of:

gripping the upper portion of such projection;

increasing progressively the width of the gap between the washer legs until the inner circumference of the washer is greater than the circumference of the upper portion of such projection; and removing the washer from the projection.

22. A method as set forth in claim 21 wherein said gripping step and said increasing step are performed by the manipulation of a first lever member and a second lever member pivotally interconnected to the first lever member at a pivotal axis, the first lever member having a gripping component attached thereto and the second lever member having a cooperating component attached thereto, the distal end of the gripping component being positioned closer to the pivotal axis of than the distal end of the cooperating component.

23. A method as set forth in claim 22 wherein said increasing step includes linearly increasing the gap between the washer legs.

24. A method as set forth in claim 21 wherein said increasing step includes exponentially increasing the gap between the washer legs.

25. A method as set forth in claim 21 wherein said increasing step includes increasing the width of the gap until the width is greater than the diameter of the groove.

26. A tool for removing a split washer from a groove in a projection; such projection having an upper portion extending above such groove; such washer having a pair of legs extending from a connecting portion; the legs being separated by a gap of a certain width smaller than the diameter of such groove such that an inner circumference of such washer is less than the circumference of the upper portion of such projection; said tool comprising:

a first lever member;

a second lever member pivotally interconnected to said first lever member at a pivotal axis;

gripping means, manipulatable by said first lever member, for gripping the upper portion of such projection; and prying means, manipulatable by said second lever member, for prying such washer off of such projection;

wherein said distal end of said gripping means is closer to said pivotal axis than the distal end of said prying means.

27. A tool as set forth in claim 26 wherein said gripping means and said prying means are integrally formed with said first lever member and said second lever member.

* * * * *